US007792633B2

(12) United States Patent
Hamama et al.

(10) Patent No.: US 7,792,633 B2
(45) Date of Patent: Sep. 7, 2010

(54) IGNITION COIL MODULE FUSE DIAGNOSTIC

(75) Inventors: Wajdi B. Hamama, Whitmore Lake, MI (US); Craig M. Sawdon, Williamston, MI (US); Eric Ferch, Northville, MI (US); Debbie L. Makowske, Commerce Township, MI (US); Dale W. McKim, Howell, MI (US); Mark D. Carr, Fenton, MI (US); Wenbo Wang, Novi, MI (US)

(73) Assignee: GM Global Technology Operations, Inc.

( * ) Notice: Subject to any disclaimer, the term of this patent is extended or adjusted under 35 U.S.C. 154(b) by 119 days.

(21) Appl. No.: 12/180,777

(22) Filed: Jul. 28, 2008

(65) Prior Publication Data

US 2010/0004846 A1 Jan. 7, 2010

Related U.S. Application Data

(60) Provisional application No. 61/077,925, filed on Jul. 3, 2008.

(51) Int. Cl.
*F02P 5/00* (2006.01)
*G06G 7/70* (2006.01)

(52) U.S. Cl. ..... 701/114; 123/406.13

(58) Field of Classification Search ..... 701/114, 701/103, 48; 123/406.13, 406.14, 406.15; 73/114.62

See application file for complete search history.

(56) References Cited

U.S. PATENT DOCUMENTS 5,575,259 A * 11/1996 Fukui et al. ..... 123/406.47
6,594,572 B1 * 7/2003 Amendt et al. ..... 701/48

* cited by examiner

*Primary Examiner*—Mahmoud Gimie

(57) ABSTRACT

A control system comprising an ignition fuse diagnostic module that determines a state of an ignition fuse associated with an ignition coil of an engine cylinder, and a fuel control module that selectively operates a fuel injector associated with the engine cylinder based on the state of the ignition fuse. A method comprising determining a state of an ignition fuse associated with an ignition coil of an engine cylinder, and selectively operating a fuel injector associated with the engine cylinder based on the state of the ignition fuse.

20 Claims, 4 Drawing Sheets

IGNITION COIL MODULE FUSE DIAGNOSTIC

CROSS-REFERENCE TO RELATED APPLICATIONS

This application claims the benefit of U.S. Provisional Application No. 61/077,925, filed on Jul. 3, 2008. The disclosure of the above application is incorporated herein by reference.

FIELD

The present disclosure relates to control systems for engines having separate ignition coil and fuel injector circuits.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Spark-ignition direct-injection (SIDI) engines include one or more fuel injectors that inject fuel directly into corresponding engine cylinders. The fuel injectors inject the fuel into the cylinders according to timing and pulse widths that are determined by an engine control module. SIDI engines may include ignition coils that have different electrical requirements (e.g., voltage, current) than the fuel injectors. Thus, SIDI engines may employ separate circuits for the ignition coils and the fuel injectors. Typically, SIDI engines include an ignition coil module for each bank of engine cylinders and a separate fuel injection module.

SUMMARY

Accordingly, the present disclosure provides a control system comprising an ignition fuse diagnostic module that determines a state of an ignition fuse associated with an ignition coil of an engine cylinder, and a fuel control module that selectively operates a fuel injector associated with the engine cylinder based on the state of the ignition fuse. In addition, the present disclosure provides a method comprising determining a state of an ignition fuse associated with an ignition coil of an engine cylinder, and selectively operating a fuel injector associated with the engine cylinder based on the state of the ignition fuse.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
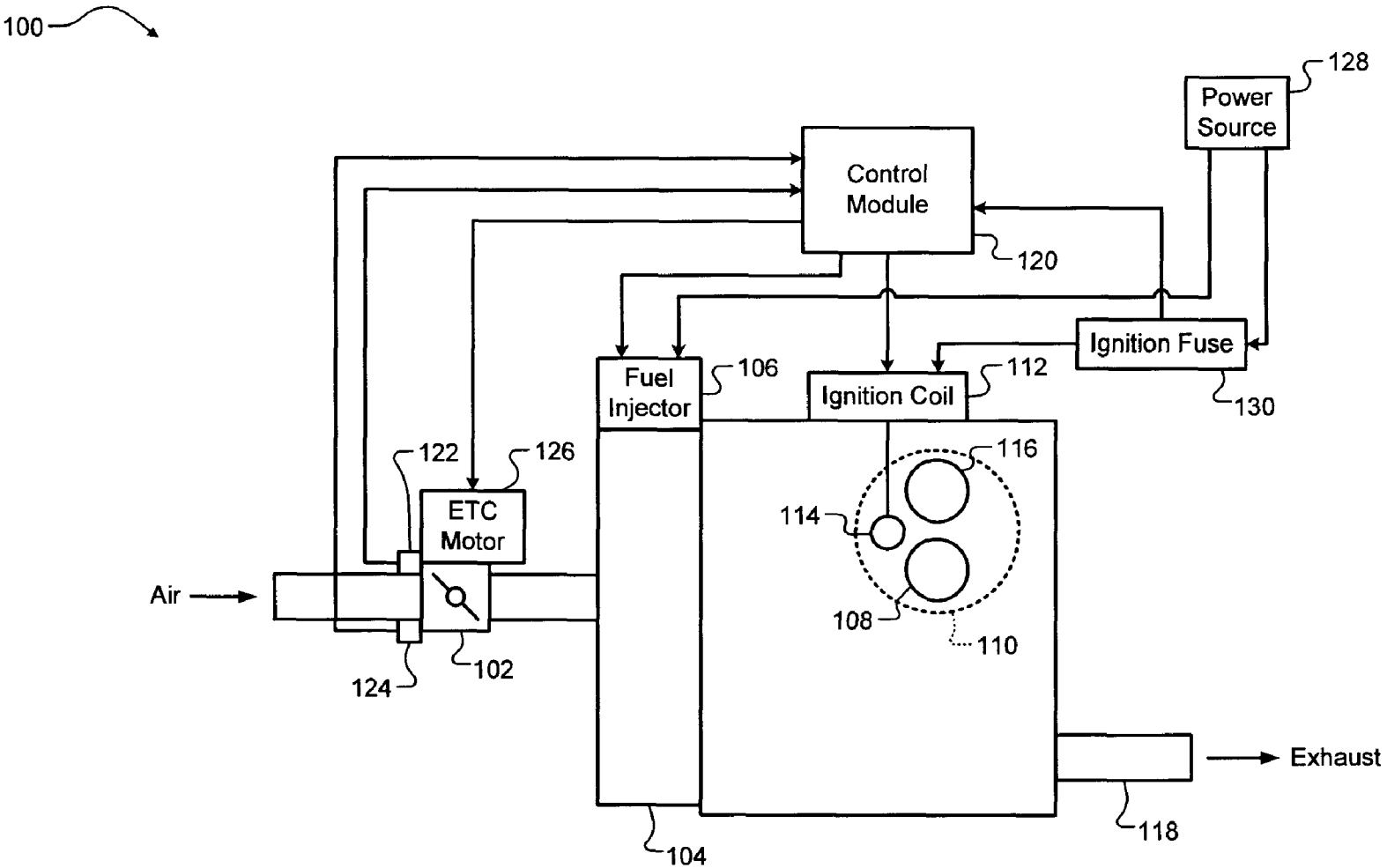
FIG. 1 is a functional block diagram of an engine control system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Some engines, such as spark-ignition direct-injection (SIDI) engines, include separate circuits for fuel injectors and ignition coils respectively providing fuel and spark to common cylinders. Typically, an ignition fuse is connected to the ignition coils to protect the ignition coils from excessive current. The ignition fuse is designed to open (i.e., blow) when current supplied to the ignition coils exceeds a threshold value. When the ignition fuse is blown, the ignition coils no longer provide spark. However, when fuel injectors and ignition coils associated with common cylinders are placed on separate circuits, the fuel injectors may continue to provide fuel after the ignition fuse is blown. In this manner, unburned fuel is passed through the exhaust system to the environment.

An engine control system according to the principles of the present disclosure detects a state of an ignition fuse connected to an ignition coil associated with a cylinder and selectively operates a fuel injector associated with the cylinder based on the state of the ignition fuse. More specifically, the engine control system detects a current through the ignition fuse to determine the state of the ignition fuse, and disables the fuel injector associated with the cylinder when the ignition fuse is blown. Disabling the injector when the ignition fuse is blown prevents engine flooding, protects exhaust components, and reduces emissions.

Referring now to FIG. 1, a functional block diagram of an engine system 100 is shown. Air is drawn through a throttle valve 102 into an intake manifold 104. Air from the intake manifold 104 is drawn into cylinders of the engine system 100.

A fuel injector 106 may inject fuel into the intake manifold 104 to create an air fuel mixture. The air fuel mixture may be drawn through an intake valve 108 into a representative cylinder 110. Alternatively, air may be drawn through the intake valve 108 into the cylinder 110 and the fuel injector 106 may inject fuel directly into the cylinder 110 to create the air fuel mixture. An ignition coil 112 activates a spark plug 114 to ignite the air/fuel mixture within the cylinder 110. After ignition, an exhaust valve 116 allows the cylinder 110 to vent the products of combustion to an exhaust system 118.

While the engine system 100 may include multiple cylinders, the single representative cylinder 110 is shown for illustration purposes only. Similarly, the singular representative fuel injector 106 and ignition coil 112 are shown although the engine system 100 may include multiple fuel injectors and ignition coils. The multiple fuel injectors and the multiple ignition coils may respectively provide fuel and spark for the single cylinder 110. Conversely, the single fuel injector 106 and the single ignition coil 112 may respectively provide fuel and spark for the multiple cylinders.

A control module 120 receives signals from first and second throttle position sensors 122 and 124. The control module 120 outputs a control signal to an electronic throttle control (ETC) motor 126, which actuates the throttle valve 102. The control module 120 controls the fuel injector 106 and the ignition coil 112. The control module 120 monitors inputs such as a position of a gas pedal (not shown), determines a desired throttle position, and instructs the ETC motor 126 to actuate the throttle valve 102 to the desired throttle position.

A power source 128 supplies power to the fuel injector 106. In addition, the power source 128 may supply power to the ignition coil 112 via an ignition fuse 130. Alternatively, a second power source (not shown) may supply power to the ignition coil 112. In each embodiment, the fuel injector 106 and the ignition coil 112 are on separate circuits.

The control module 120 detects a state of the ignition fuse 130 connected to an ignition coil associated with a cylinder and selectively operates a fuel injector associated with the cylinder based on the state of the ignition fuse. More specifically, the control module 120 determines whether a current through the ignition fuse 130 is less than a predetermined threshold, indicating the ignition fuse is blown, and disables the fuel injector associated with the cylinder when the ignition fuse is blown. Disabling the injector when the ignition fuse is blown prevents engine flooding, protects exhaust components, and reduces emissions.

Figure 2:
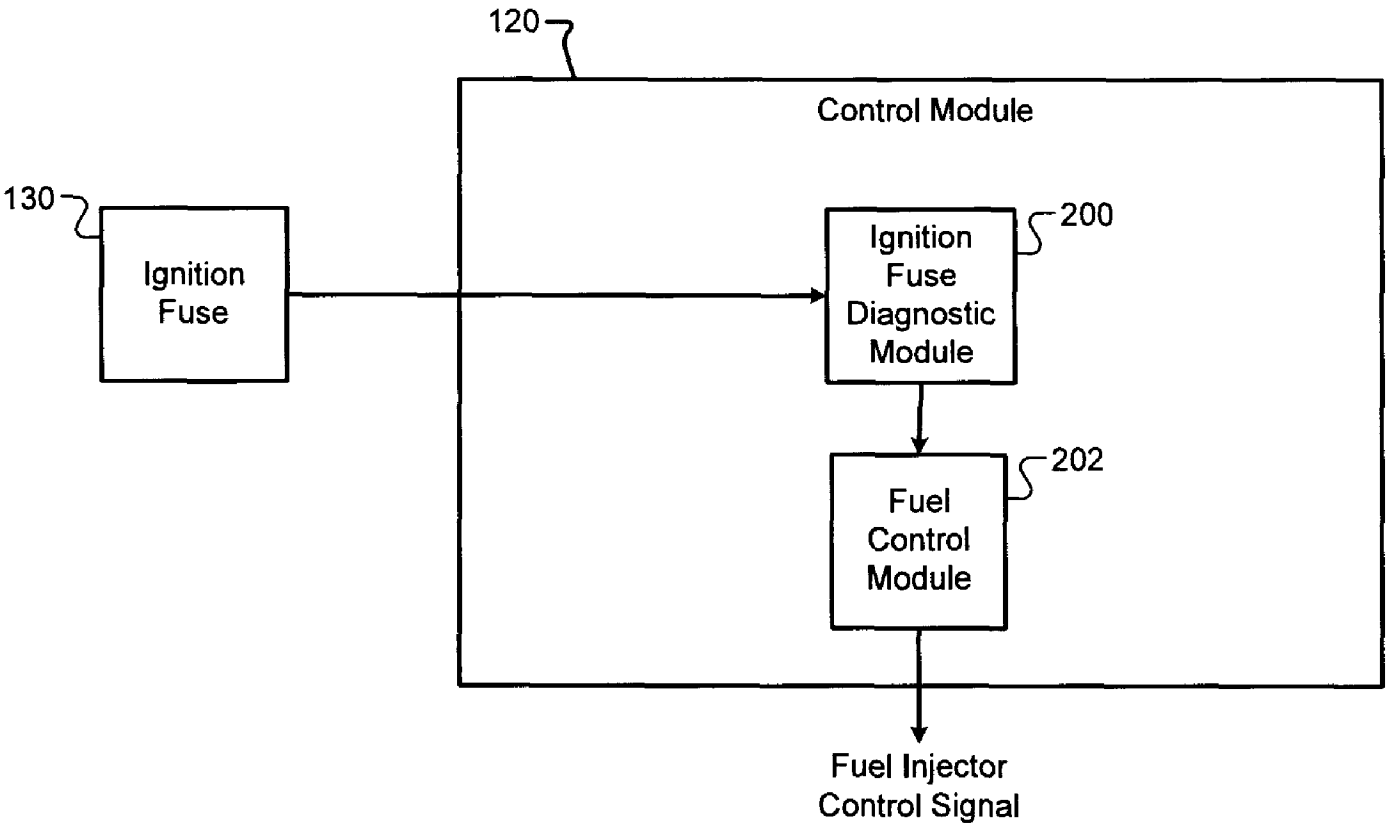
FIG. 2 is a functional block diagram illustrating a control module associated with an engine control system according to the principles of the present disclosure.

Referring now to FIG. 2, a functional block diagram illustrates the control module 120 including an ignition fuse diagnostic module 200 and a fuel control module 202. The ignition fuse diagnostic module 200 determines a state of the ignition fuse 130 at a predetermined rate when power is supplied to the ignition fuse 130. For example, current through the ignition fuse 130 may be interrupted or significantly reduced when the ignition fuse 130 is blown. The ignition fuse diagnostic module 200 may receive a signal from the ignition fuse 130 that is indicative of the current through the ignition fuse 130. When the current decreases below a threshold, the ignition fuse diagnostic module 200 determines that the ignition fuse 130 is blown. The fuel control module 202 receives the state of the ignition fuse 130 from the ignition fuse diagnostic module 200. When the ignition fuse is blown, the fuel control module 202 disables the fuel injector 106.

Referring to FIG. 1, the engine system 100 may include two banks of multiple cylinders (i.e., two sets of cylinders arranged on the left and right or front and rear of the engine system 100). The single ignition coil 112 may provide spark to each bank of cylinders, and one or more fuel injectors may provide fuel to each bank of cylinders. Thus, the ignition fuse diagnostic module 200 may determine the state of the ignition fuse 130 connected to the ignition coil 112 providing spark to a bank of cylinders, and the fuel control module may disable the one or more fuel injectors providing fuel to the bank of cylinders when the ignition fuse 130 is blown.

Figure 3:
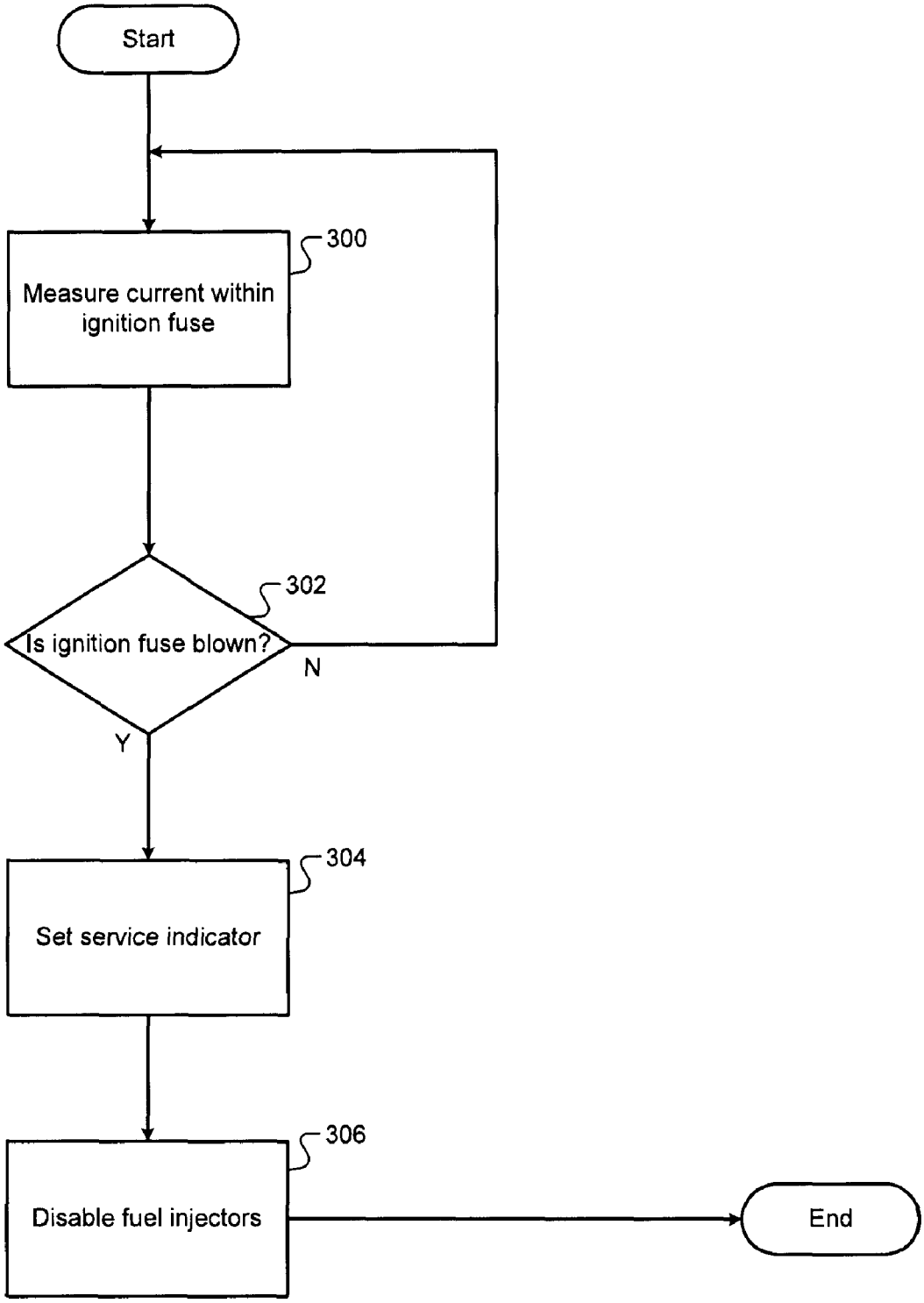
FIG. 3 is a flowchart illustrating exemplary steps of an engine control method according to the principles of the present disclosure.

Referring now to FIG. 3, a flowchart illustrates exemplary steps executed by the control module 120. In step 300, control measures current through the ignition fuse 130. In step 302, control determines whether the ignition fuse 130 is blown. When the ignition fuse 130 is blown, control sets a service indicator and disables the fuel injector 106 in steps 304 and 306, respectively. Control may disable the fuel injector 106 when the service indictor is set. When the ignition fuse 130 is not blown, control returns to step 300.

Figure 4:
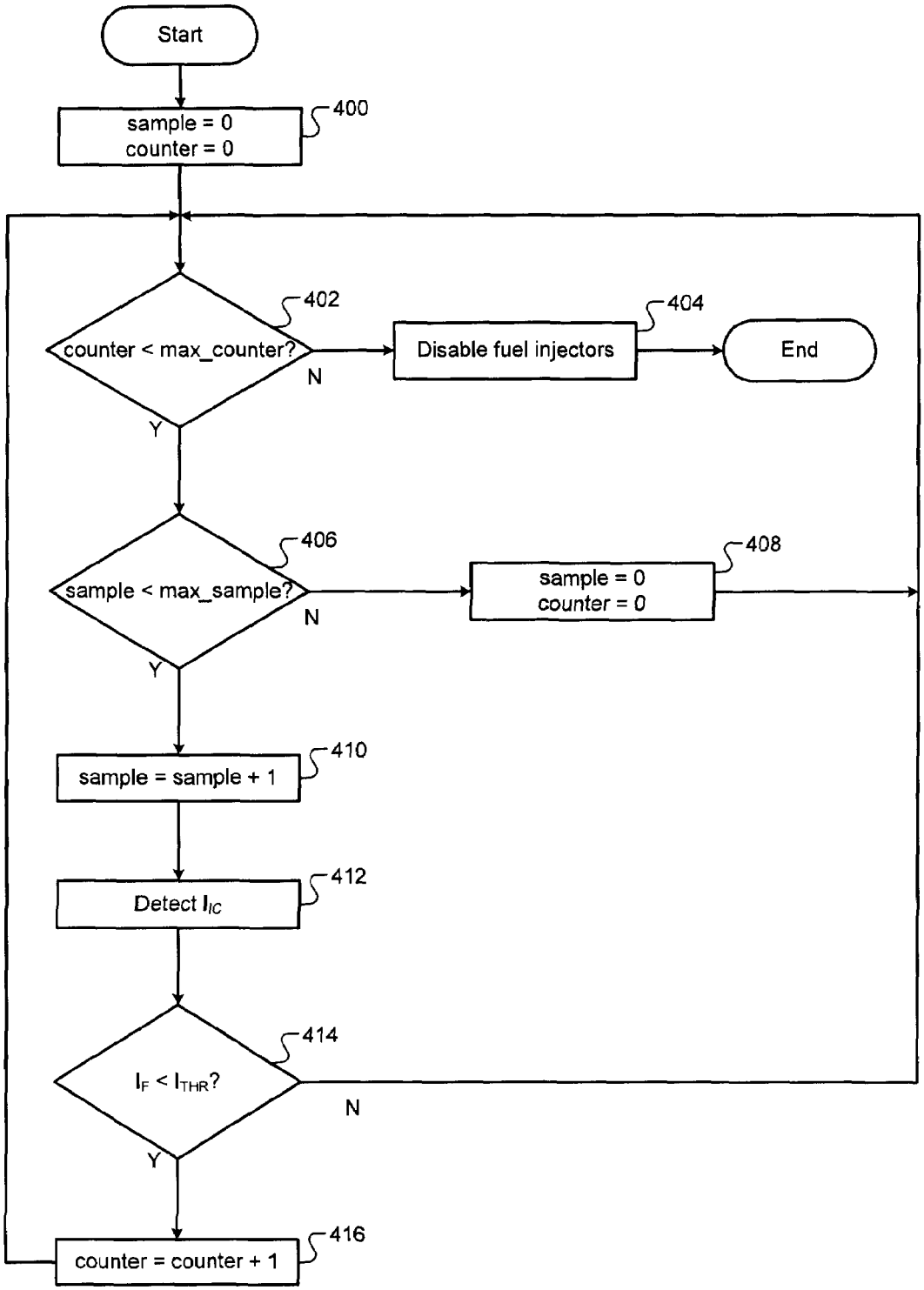
FIG. 4 is second flowchart illustrating exemplary steps of an engine control method according to the principles of the present disclosure.

Referring now to FIG. 4, a second flowchart illustrates additional exemplary steps executed by the control module 120. In step 400, control sets sample and counter equal to 0. Sample indicates the number of times the current through the ignition fuse 130 has been detected, and counter indicates the number of times the current is less than a predetermined threshold current.

In steps 402 through 416, control determines the ignition fuse 130 is blown when current through the ignition fuse 130 is less than a predetermined threshold current for a predetermined number of samples (maximum counter) within a predetermined sampling interval (maximum sample). In step 402, control determines whether the counter is less than the maximum counter. When counter is not less than the maximum counter, indicating the ignition fuse 130 is blown, control disables the fuel injector 106 in step 404.

When the counter is less than the maximum counter, control determines whether the sample is less than the maximum sample in step 406. When the sample is not less than the maximum sample, control sets sample and counter equal to 0 in step 408. When the sample is less than the maximum sample, control increases sample by 1 in step 410 and detects a current through the ignition fuse 130 in step 412.

In step 414, control determines whether the current through the ignition fuse 130 is less than the threshold current. When current through the ignition fuse 130 is not less than the threshold current, control returns to step 402. When current through the ignition fuse 130 is less than the threshold current, control increases counter by 1 in step 416 and returns to step 402.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

an ignition fuse diagnostic module that determines a state of an ignition fuse associated with an ignition coil of an engine cylinder; and a fuel control module that selectively operates a fuel injector associated with said engine cylinder based on said state of said ignition fuse, wherein said ignition coil and said fuel injector are on separate circuits.

2. The control system of claim 1 wherein said fuel control module disables said fuel injector when said ignition fuse is blown.

3. The control system of claim 1 wherein said ignition coil and said fuel injector are associated with a bank of engine cylinders and said fuel control module disables said fuel injector when said ignition fuse is blown.

4. The control system of claim 1 wherein said ignition fuse diagnostic module determines said state of said ignition fuse when power is supplied to said ignition fuse.

5. The control system of claim 1 wherein said fuel injector and said ignition coil receive power from separate circuits.

6. The control system of claim 1 wherein:

said ignition fuse diagnostic module sets a service indicator when said ignition fuse is blown; and said fuel control module disables said fuel injector when said service indicator is set.

7. The control system of claim 1 wherein said ignition fuse diagnostic module detects a current through said ignition fuse and determines said state of said ignition fuse based on said current.

8. The control system of claim 7 wherein:

said ignition fuse diagnostic module determines said ignition fuse is blown when said current is less than a predetermined threshold; and said fuel control module disables said fuel injector when said ignition fuse is blown.

9. The control system of claim 7 wherein said ignition fuse diagnostic module determines said state of said ignition fuse at a predetermined rate.

10. The control system of claim 9 wherein:

said ignition fuse diagnostic module determines said ignition fuse is blown when said current is less than a predetermined threshold for a predetermined number of samples within a predetermined sampling interval; and said fuel control module disables said fuel injector when said ignition fuse is blown.

11. A method, comprising:

determining a state of an ignition fuse associated with an ignition coil of an engine cylinder; and selectively operating a fuel injector associated with said engine cylinder based on said state of said ignition fuse, wherein said ignition coil and said fuel injector are on separate circuits.

12. The method of claim 11 further comprising disabling said fuel injector when said ignition fuse is blown.

13. The method of claim 11 further comprising disabling said fuel injector when said ignition fuse is blown, wherein said ignition coil and said fuel injector are associated with a bank of engine cylinders.

14. The method of claim 11 further comprising determining said state of said ignition fuse when power is supplied to said ignition fuse.

15. The method of claim 11 wherein said fuel injector and said ignition coil receive power from separate circuits.

16. The method of claim 11 further comprising:

setting a service indicator when said ignition fuse is blown; and disabling said fuel injector when said service indicator is set.

17. The method of claim 11 further comprising detecting a current through said ignition fuse and determining said state of said ignition fuse based on said current.

18. The method of claim 17 further comprising:

determining said ignition fuse is blown when current through said ignition circuit is less than a predetermined threshold; and disabling said fuel injector when said ignition fuse is blown.

19. The method of claim 17 further comprising determining said state of said ignition fuse at a predetermined rate.

20. The method of claim 19 further comprising:

determining said ignition fuse is blown when current through said ignition circuit is less than a predetermined threshold for a predetermined number of samples within a predetermined sampling interval; and disabling said fuel injector when said ignition fuse is blown.

* * * * *